US007730957B2

(12) United States Patent
Blanton et al.

(10) Patent No.: US 7,730,957 B2
(45) Date of Patent: Jun. 8, 2010

(54) WELL TOOL WITH LINE AND INSTALLATION METHOD

(75) Inventors: James R. Blanton, Allen, TX (US); Ronald W. McGregor, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 16 days.

(21) Appl. No.: 11/832,623

(22) Filed: Aug. 1, 2007

(65) Prior Publication Data

US 2009/0032268 A1 Feb. 5, 2009

(51) Int. Cl.
*E21B 19/16* (2006.01)
*E21B 17/00* (2006.01)

(52) U.S. Cl. ..... 166/385; 166/380; 166/242.2; 166/242.6; 166/242.7; 175/321

(58) Field of Classification Search ..... 175/321; 166/242.7, 380, 385, 65.1, 242.2, 242.6
See application file for complete search history.

(56) References Cited

U.S. PATENT DOCUMENTS 3,602,304 A * 8/1971 Mallinger et al. ..... 166/63
4,124,070 A * 11/1978 King et al. ..... 166/255.1
4,600,059 A * 7/1986 Eggleston et al. ..... 166/385
4,720,124 A 1/1988 Taylor et al.
5,566,772 A * 10/1996 Coone et al. ..... 175/321
5,727,630 A 3/1998 Brammer
5,823,264 A 10/1998 Ringgenberg
6,334,633 B1 1/2002 Nguyen et al.
2005/0045339 A1 * 3/2005 Hall et al. ..... 166/380

FOREIGN PATENT DOCUMENTS

CA 1253436 5/1989

OTHER PUBLICATIONS

Halliburton Technology Test Report No. 8938.04030 for P/N 31T2960, entitled "Stroking of Fiber Optic Control Line Coil with DTS," 10 pages, dated Mar. 1, 2004.
Schlumberger, "Model A Adjustable Joint," www.slb.com/oilfield (Dec. 2003).

* cited by examiner

*Primary Examiner*—David J Bagnell
*Assistant Examiner*—Cathleen R Hutchins
(74) *Attorney, Agent, or Firm*—Marlin R. Smith

(57) ABSTRACT

Installation of lines in well tools. A well tool for use in conjunction with a subterranean well includes connectors at opposite ends of the well tool, a line extending between the connectors; at least one threaded connection at a position between the connectors; and an anti-rotation device which permits make-up of the threaded connection without relative rotation between ends of the line. A method of installing a line in a well tool includes the steps of: making-up a threaded connection at a position between end connectors of the well tool; and preventing relative rotation between ends of the line during the threaded connection making-up step, the line extending between the connectors.

16 Claims, 6 Drawing Sheets

WELL TOOL WITH LINE AND INSTALLATION METHOD

BACKGROUND

The present invention relates generally to equipment utilized and operations performed in conjunction with subterranean wells and, in an embodiment described herein, more particularly provides for installation of lines in well tools.

It is frequently desirable to be able to extend one or more lines through well tools. However, if threaded connections have to be made-up between end connectors of a well tool, there is a disadvantage in that torque may be applied to the line(s) in the well tool, thereby damaging the line(s).

Therefore, it may be seen that improvements are needed in the art of installing lines in well tools.

SUMMARY

In carrying out the principles of the present invention, installation of a line in a well tool is provided in a manner which solves at least one problem in the art. One example is described below in which torque is not applied to the line while threaded connections of the well tool are made-up. Another example is described below in which an anti-rotation device of the well tool transmits torque between end connectors of the well tool.

In one aspect, a method of installing a line in a well tool includes the steps of: making-up a threaded connection at a position between end connectors of the well tool; and preventing relative rotation between ends of a line extending between the connectors during the threaded connection making-up step.

In another aspect, a well tool for use in conjunction with a subterranean well includes connectors at opposite ends of the well tool. A line extends between the end connectors. At least one threaded connection is at a position between the end connectors.

An anti-rotation device permits make-up of the threaded connection without relative rotation between opposite ends of the line. Additionally, the anti-rotation device transmits torque of the entire tubing string through the tool during installation of the string in the well. This enables transmission of torque, e.g., to force the tubing string through doglegs or tight spots in the well.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
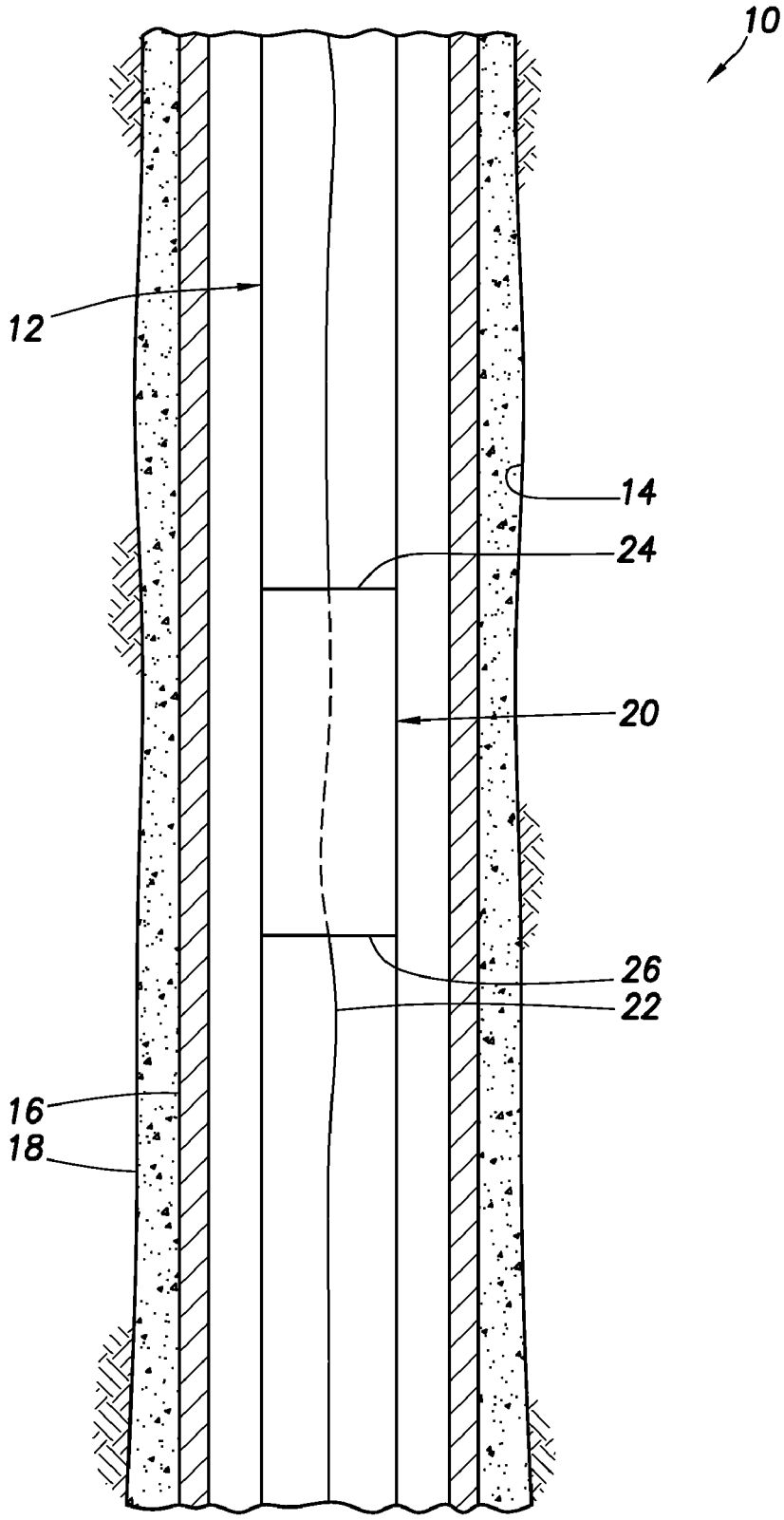
FIG. 1 is a schematic partially cross-sectional view of a well system and associated method embodying principles of the present invention.

Representatively illustrated in FIG. 1 is a well system 10 which embodies principles of the present invention. In the system 10, a tubular string 12 is installed in a wellbore 14. The tubular string 12 may be a completion or production string, and the wellbore 14 may be lined with casing 16 and cement 18, but it is to be clearly understood that the particular details of the system 10 as depicted in FIG. 1 and described herein are not necessary in accordance with the principles of the invention.

The tubular string 12 has a well tool 20 interconnected therein. In this embodiment, the well tool 20 may be a travel or telescoping joint which enables the length of the tubular string 12 to be adjusted to accommodate particular completion configurations, temperature changes, etc. However, other types of well tools may also incorporate the principles of the invention.

A line 22 extends longitudinally along the tubular string 12. The line 22 also extends through the well tool 20 between upper and lower end connectors 24, 26 used to interconnect the well tool in the tubular string 12.

The line 22 may be any type of line which may be used in conjunction with well operations. For example, the line 22 could be one or more hydraulic lines (such as a valve control line, chemical injection line, etc.), electrical lines (for example, to provide power and/or transmit data, command and/or control signals between remote locations and downhole tools, sensors, etc.), optical lines (for example, to transmit data, command and/or control signals between remote locations and downhole tools, sensors, etc.), or any other type of line, or combination of lines.

In one important feature of the well tool 20, threaded connections in the well tool between the connectors 24, 26 can be made-up while the line 22 extends between the connectors, but without any torque being transmitted to the line, and without any relative rotation between ends of the line while the threaded connections are being made-up. Note that the line 22 preferably does not extend through the connectors 24, 26 while the connectors are being made-up.

Figure 2:
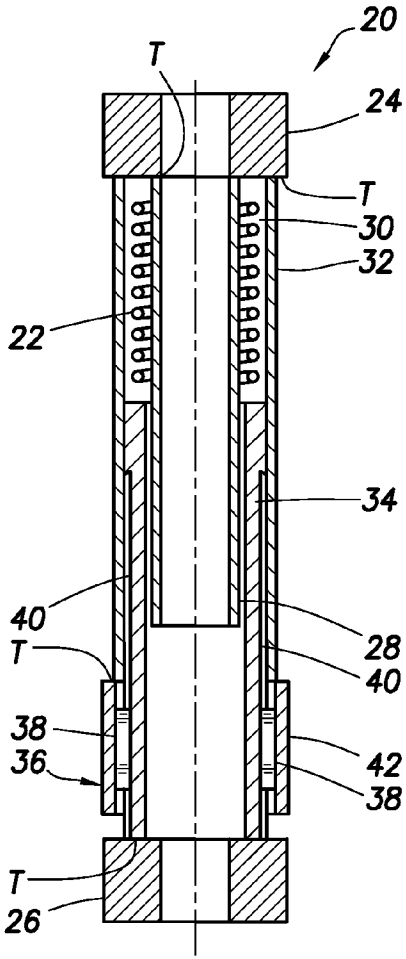
FIG. 2 is an enlarged scale schematic cross-sectional view of a well tool embodying principles of the invention, and which may be used in the well system of FIG. 1.

Referring additionally now to FIG. 2, a schematic cross-sectional view of the well tool 20 in its longitudinally compressed or retracted configuration is representatively illustrated. In this view it may be seen that the line 22 is coiled about a generally tubular inner mandrel 28 and is positioned in an annular space 30 between the inner mandrel and an outer housing 32. The line 22 is also secured to the end connectors 24, 26 and extends longitudinally through a sleeve 34 which is secured to the end connector 26 and is reciprocably disposed relative to the inner mandrel 28 and outer housing 32.

An anti-rotation device 36 is specially configured to prevent relative rotation between the outer housing 32 and the sleeve 34. The device 36 transmits torque between the outer housing 32 and the sleeve 34 while permitting relative longitudinal displacement between the outer housing and sleeve.

In this example, the device 36 includes projections 38 in the form of elongated splines which engage elongated recesses 40 formed externally on the sleeve 34. Of course, other arrangements and configurations of the device 36 could be used in keeping with the principles of the invention.

Any number and positioning of the projections 38 and recesses 40 may be used as desired (for example, the recesses could be formed on a housing 42 of the device 36, and the projections could be formed on the sleeve 34). In addition, other types of projections (such as pins, lugs, dogs, etc.) and other types of recesses (such as grooves, slots, etc.) may be used, and the projections or recesses could be integrally or separately formed on any of the elements of the well tool 20, in keeping with the principles of the invention.

Multiple threaded connections T are used between the various elements of the well tool 20 at positions located between the end connectors 24, 26. These threaded connections T are utilized without requiring relative rotation between ends of the line 22 during assembly of the well tool 20, as described more fully below.

Figure 3:
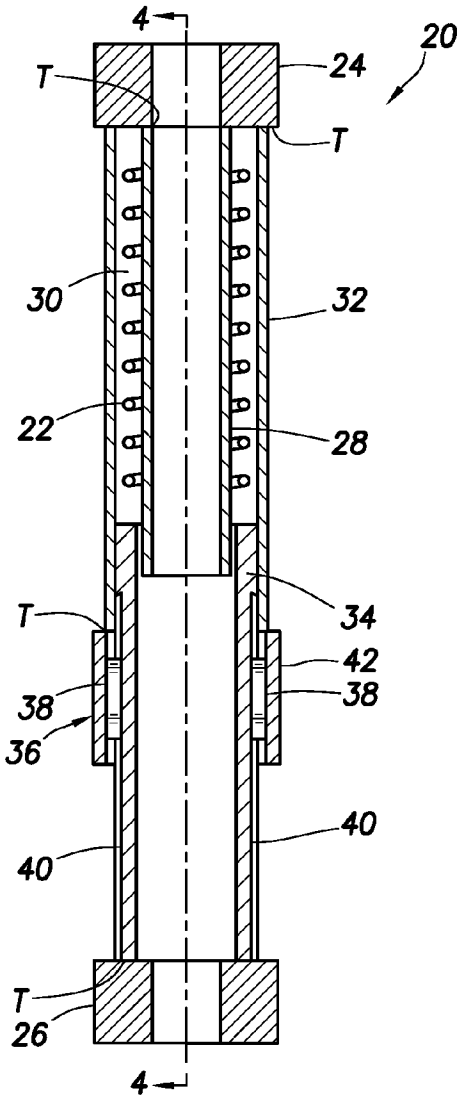
FIG. 3 is a schematic cross-sectional view of the well tool in a longitudinally extended configuration.

Referring additionally now to FIG. 3, the well tool 20 is representatively illustrated in an elongated, longitudinally extended configuration. In this view it may be seen how the line 22 is permitted to elongate in the annular space 30 between the outer housing 32 and the inner mandrel 28, and longitudinally between the end connector 24 and the sleeve 34.

Figure 4:
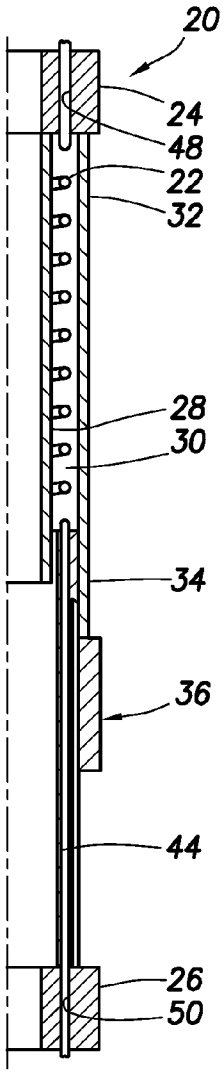
FIG. 4 is a schematic quarter-sectional view of the well tool, taken along line 4-4 of FIG. 3.

Referring additionally now to FIG. 4, a quarter-sectional view of the well tool 20 is representatively illustrated, taken along line 4-4 of FIG. 3. In this view it may be seen how the line 22 extends longitudinally through the end connectors 24, 26 and the sleeve 34. The line 22 is preferably positioned in a recess or slot 44 formed longitudinally on the sleeve 34, and which is circumferentially offset from the recesses 40, but other configurations may be used in keeping with the principles of the invention.

Figure 5A:
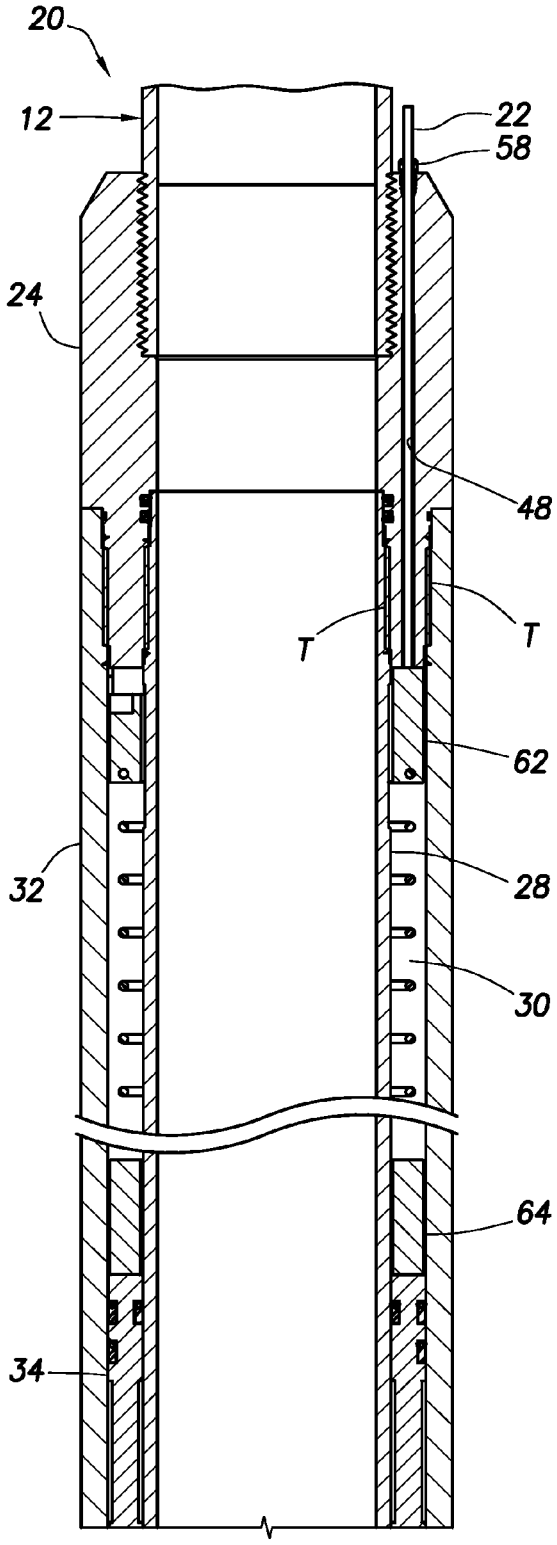
FIGS. 5A-C are enlarged scale detailed cross-sectional views of successive axial sections of the well tool in a longitudinally compressed configuration.
Figure 6A:
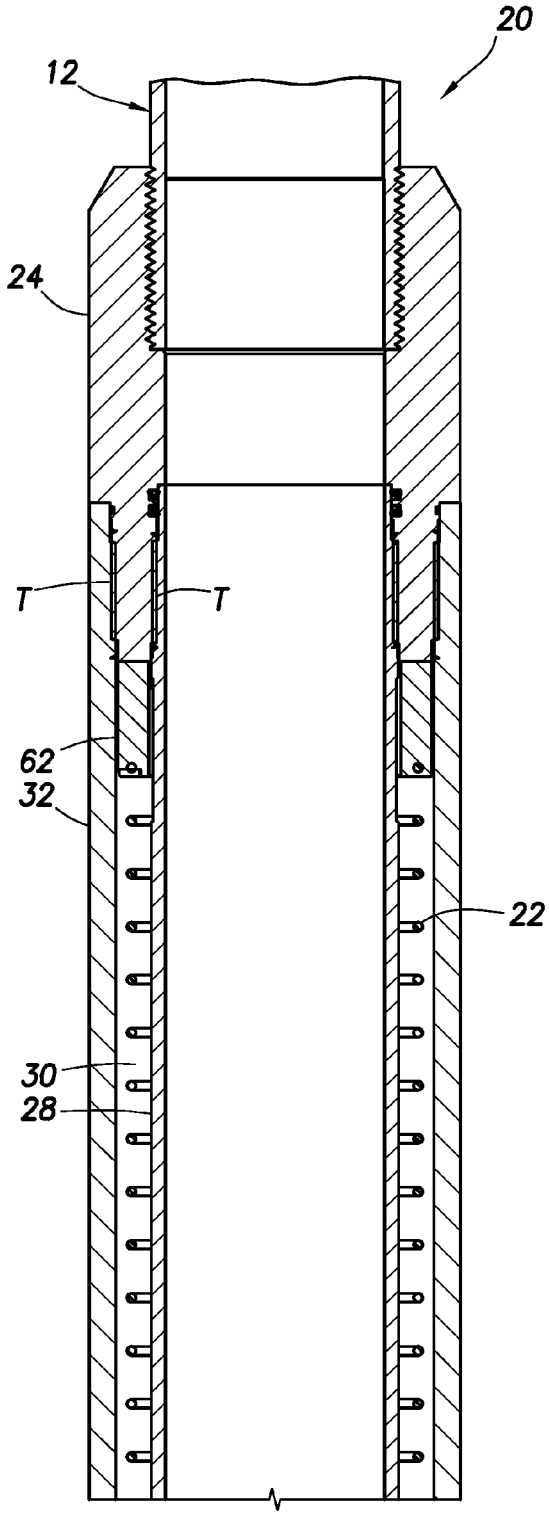
FIGS. 6A-D are cross-sectional views of successive axial sections of the well tool in a longitudinally extended configuration.
Figure 5B:
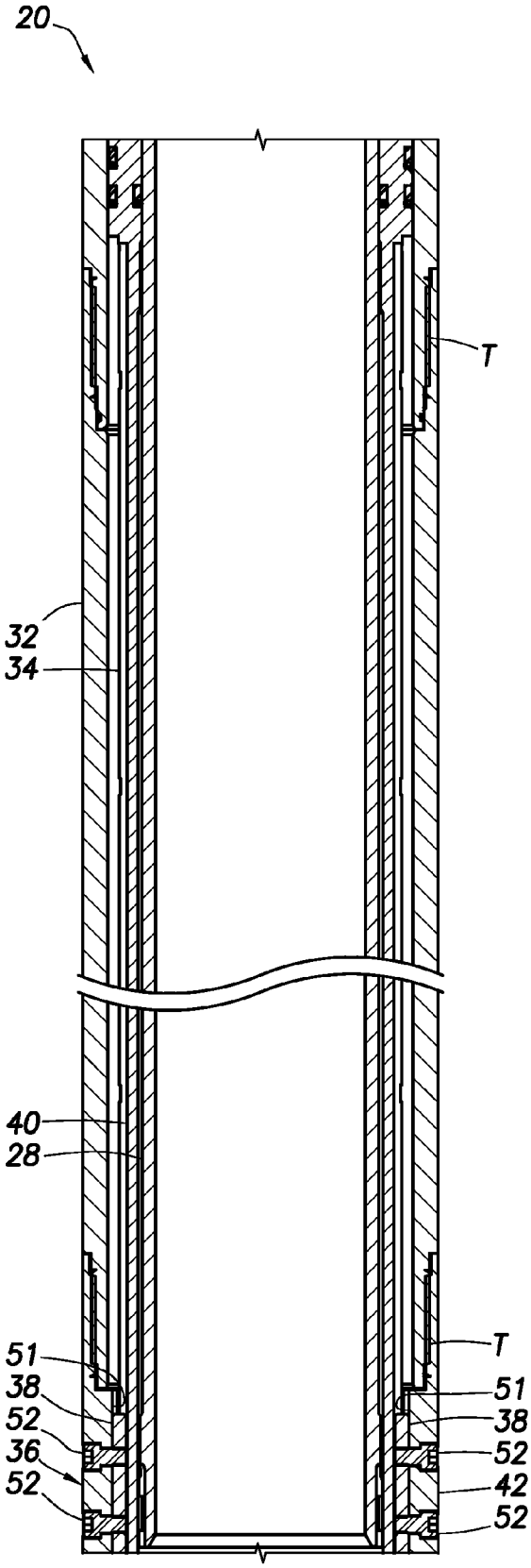
Figure 6B:
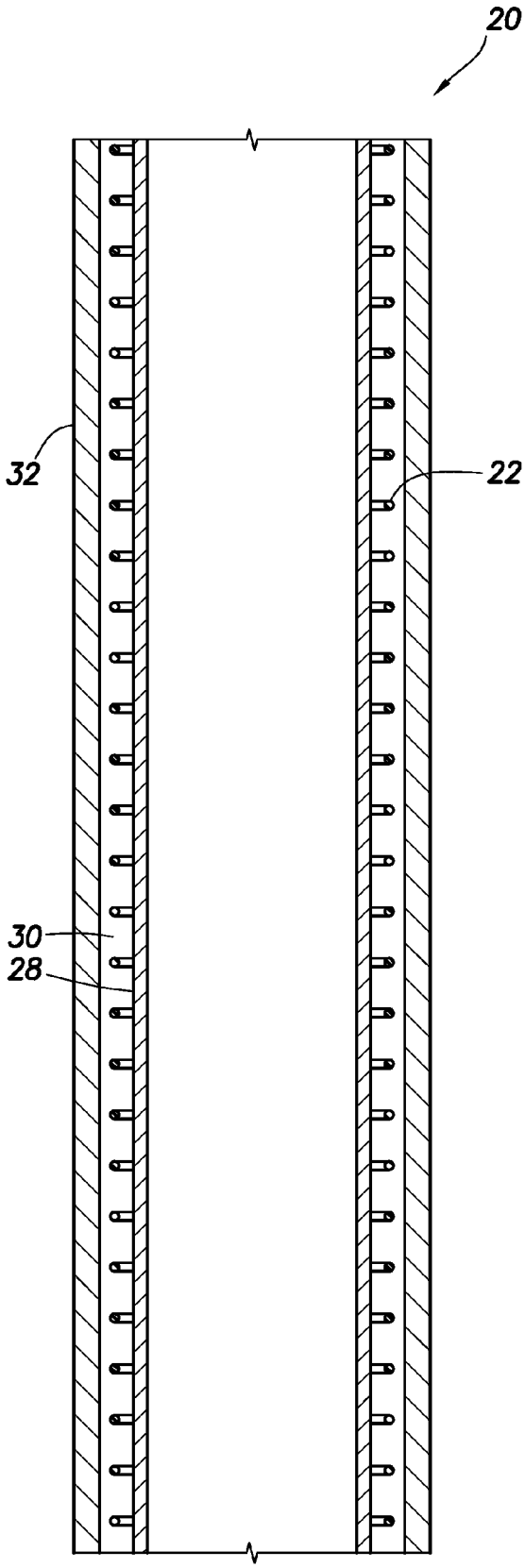
Figure 5C:
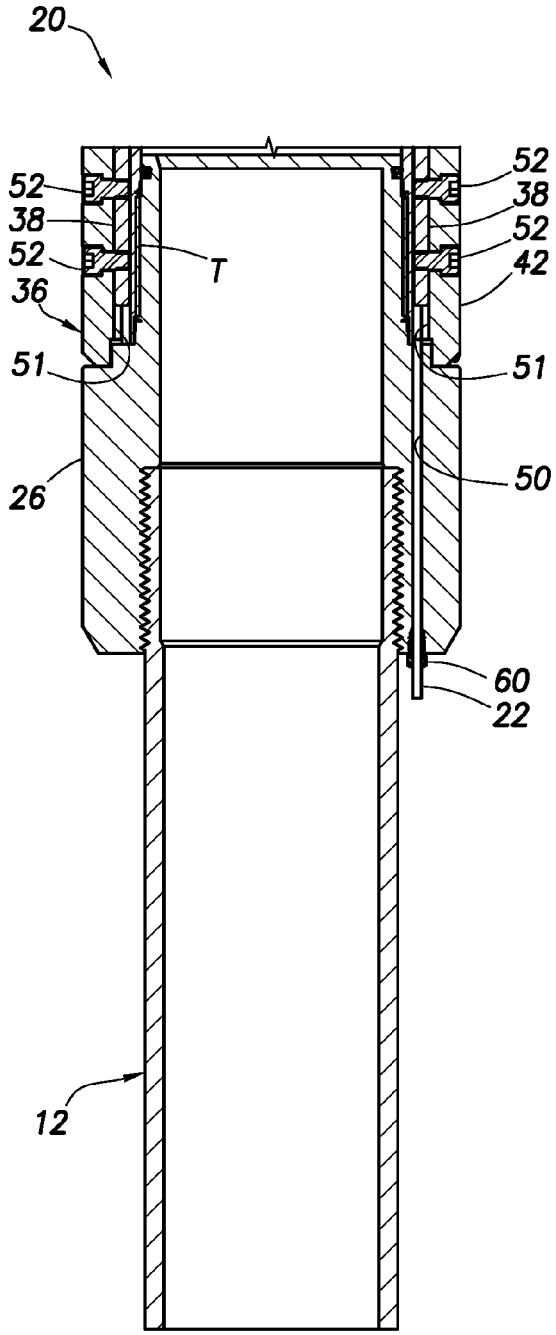
Figure 6C:
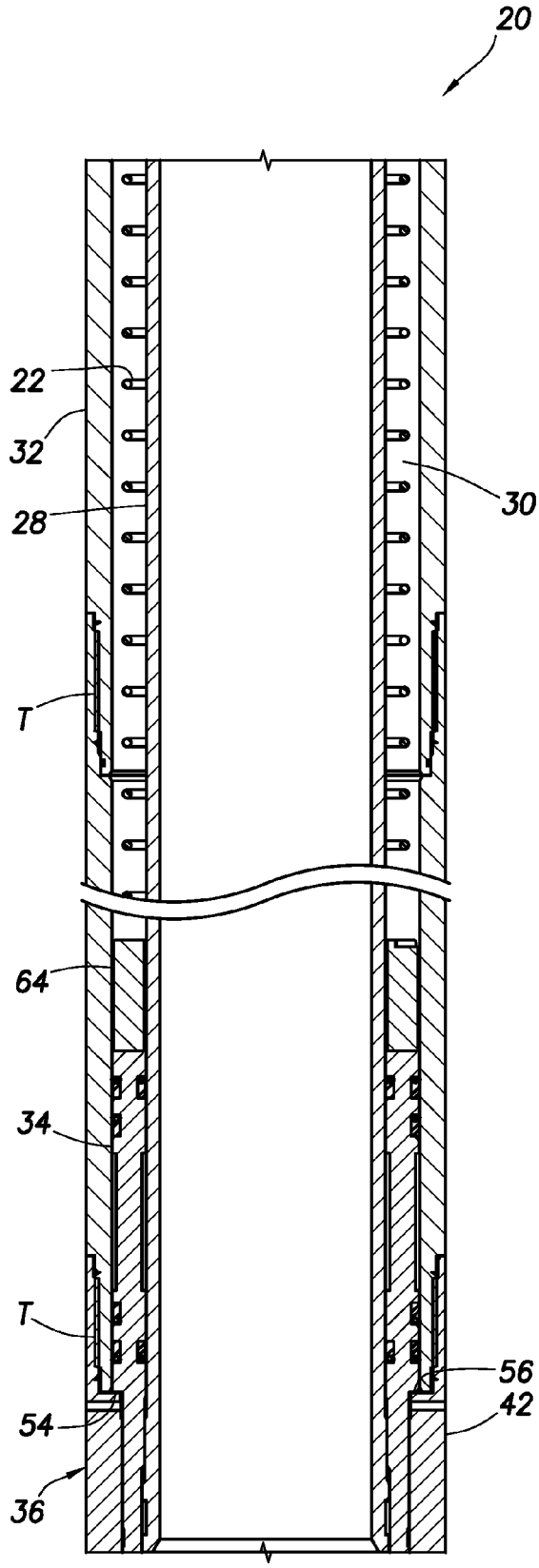

Referring additionally now to FIGS. 5A-C, a cross-sectional view of the well tool 20 is representatively illustrated in further detail and at an enlarged scale. In this view the well tool 20 is in its longitudinally compressed or retracted configuration.

Note that the end connector 26 in FIG. 5C is depicted rotationally offset from its actual orientation relative to the anti-rotation device 36, so that the manner in which the line 22 extends longitudinally through the connector can be seen. In its actual orientation, the line 22 would preferably not be aligned with one of the projections 38 in the device 36.

Referring additionally now to FIGS. 6A-D, another cross-sectional view of the well tool 20 is representatively illustrated. In this view the well tool 20 is in its longitudinally extended or elongated configuration.

Figure 7:
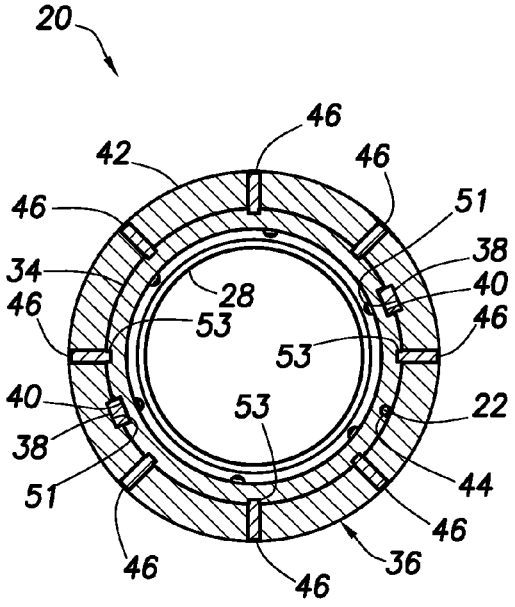
FIG. 7 is a cross-sectional view of the well tool, taken along line 7-7 of FIG. 6D.
Figure 6D:
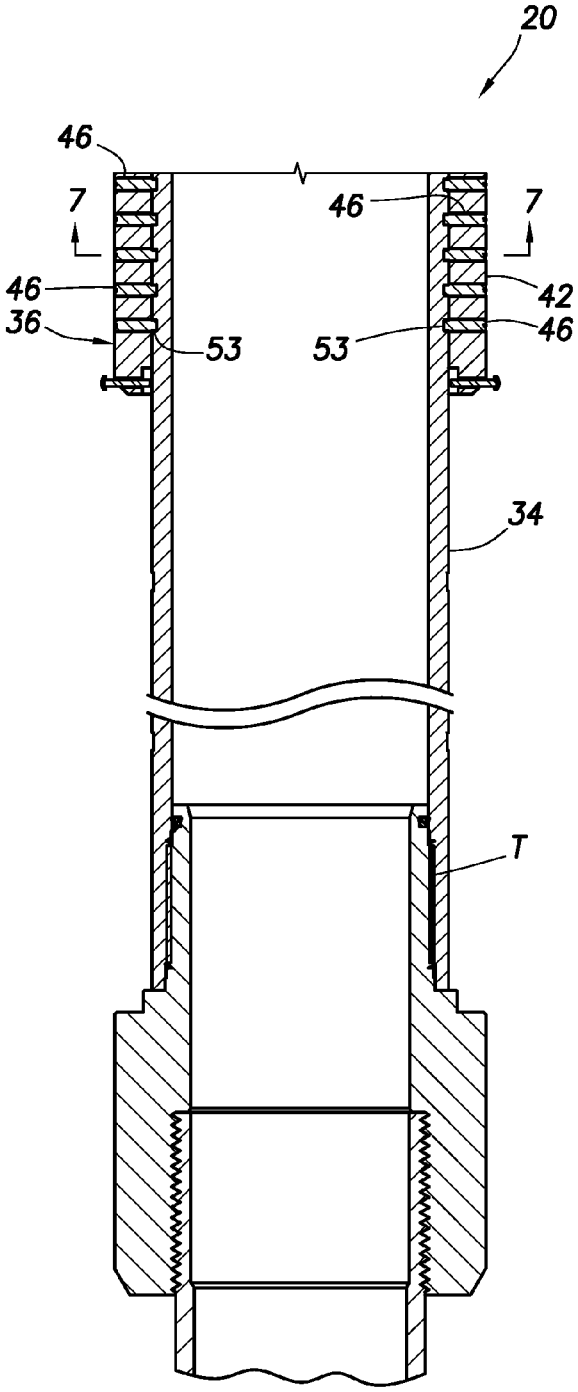

Referring additionally now to FIG. 7, a cross-sectional view of the well tool 20 is representatively illustrated, taken along line 7-7 of FIG. 6D. In this view the circumferential orientation of the line 22, slot 44, projections 38 and recesses 40 may be seen. In addition, the manner of circumferentially spacing shear screws 46 about the device housing 42 to releasably secure the housing relative to the sleeve 34 may be seen.

A method of installing the line 22 in the well tool 20 prevents torque from being applied to the line as the various threaded connections are made-up. This prevents damage to the line 22 and allows the opposite ends of the line to remain in their same circumferential positions relative to each other for alignment with the slot 44 in the sleeve 34, and with openings 48, 50 in the end connectors 24, 26 (see FIGS. 5A & C).

To begin the method, the inner mandrel 28 is inserted into the sleeve 34. The line 22 is then installed over the inner mandrel 28. When installed on the inner mandrel 28, the line 22 has its coiled configuration on one end.

Referring to FIGS. 4 & 6D, the lower straight end of the line 22 is inserted into the slot 44 in the sleeve 34. The device housing 42 is then installed onto the sleeve 34, without the projections 38 and shear screws 46 being installed therein.

The end connector 26 is threaded onto the sleeve 34, and then the lower end of the line 22 is inserted through the opening 50 in the connector. This subassembly (inner mandrel 28, sleeve 34, line 22 and end connector 26) is then inserted into the outer housing 32.

Prior to inserting the lower end of the line 22 through the opening 50 in the end connector 26, the connector is preferably match drilled to accept the line. This is preferably accomplished by torquing the threads of the connector 26 and sleeve 34 on and off in progressive steps up to the maximum torque of the thread. A longitudinal alignment mark is then made on the connector 26 outer diameter aligned with the line 22 in the slot 44 in the sleeve 34. The connector 26 is unthreaded and a hole is drilled (registered with the alignment mark) through the connector for receiving the line 22 therein. The connector 26 is made up once more on the sleeve 34 and tightened to the required torque, and then the lower end of the line 22 is inserted into the opening 50 in the connector and secured with the tube fitting 60 on the bottom of the connector.

The end connector 24 is threaded onto the inner mandrel 28, which extends outwardly from the outer housing 32 at this point. The short straight upper end of the line 22 is then inserted through the opening 48 in the end connector 24.

The device housing 42 is threaded into the outer housing 32. The outer housing 32 is then threaded onto the end connector 24. Preferably, in this operation no relative rotation is permitted between the end connectors 24, 26, since the ends of the line 22 are in the openings 48, 50 in the connectors.

The sleeve 34 is withdrawn from the device housing 42 sufficiently far, so that the projections 38 can be installed in the recesses 40. The device housing 42 has complementary recesses 51 formed therein to receive the projections 38.

The recesses 40, 51 are aligned by rotating the device housing 42 relative to the sleeve 34 as needed, so that the projections 38 can be inserted into the device housing while the projections engage both sets of recesses. This rotation, if needed, may cause relative rotation between the ends of the line 22 somewhat, but the amount of relative rotation should be insignificant, and should certainly be less than that otherwise required to make-up the threaded connections T.

Fasteners 52 are used to secure the projections 38 in the device housing 42. The well tool 20 may then be stroked to its fully extended configuration (as depicted in FIGS. 6A-D) and one or more shear screws 46 may be installed through the device housing 42 and into recesses 53 in the sleeve 34 to releasably secure the well tool against premature retraction.

Note that an external shoulder 54 formed on the sleeve 34 engages an internal shoulder 56 formed on the device housing 42 to thereby limit the amount by which the sleeve may be withdrawn from within the outer housing 32.

Tube fittings 58, 60 may be used to sealingly secure the ends of the line 22 to the end connectors 24, 26. A similar tube fitting (not shown) may be used in the end of sleeve 34 and surrounded by spacer 64 at one end of the annular space 30 to provide strain relief and sealing for the line 22. Spacers 62, 64 preferably also have recesses (not shown) formed therein to provide space to accommodate and guide the transition between the coiled and straight portions of the line 22.

The spacers 62, 64 guide the curved transition of the line 22 to prevent it from kinking as the line reciprocates in the annular space 30. The spacers 62, 64 have curved grooves to restrain the line 22 to a minimum bend radius configuration, and to prevent kinking during reciprocation.

The annular space 30 is preferably filled with a fluid, such as oil, prior to running the tool 20 into the well. The fluid helps to dampen the collapse motion of the tool 20, and to exclude well fluid intrusion into the space 30 via fill and bleed ports (not shown) in the upper connector 24. The annular space 30 is in communication with the annulus between the tubular string 12 and the casing string 16 via the fill and bleed ports.

The various elements of the well tool 20 may be sealed to each other using various types of seals. As depicted in the accompanying illustrations, preferably each of the threaded connections T is a sealed connection. In addition, the sleeve 34 is at an upper end thereof preferably sealed to the inner mandrel 28 and the outer housing 32.

From the foregoing description of the method, and the FIGS. 2-6D and description thereof above, it will be appreciated that the threaded connections T prevent unrestrained displacement of the connector 24 relative to the connector 25. After assembly of the well tool 20, only limited displacement of the connectors 24, 25 relative to each other is permitted.

It may now be fully appreciated that the above detailed description provides examples of the improvements in the art afforded by the principles of the invention. In particular, a well tool 20 for use in conjunction with a subterranean well is provided which includes connectors 24, 26 at opposite ends of the well tool 20, a line 22 extending between the connectors 24, 26, one or more threaded connections T at positions between the connectors 24, 26 and an anti-rotation device 36 which permits make-up of the threaded connections T without relative rotation between ends of the line 22.

The line 22 may be coiled about an inner mandrel 28 secured to the connector 24. The line 22 may be secured to the connector 24 and to a sleeve 34 reciprocably disposed on the inner mandrel 28 and secured to the other connector 26.

The sleeve 34 may be reciprocably disposed within an outer housing 32 secured to the connector 24. The anti-rotation device 36 may permit relative longitudinal displacement between the outer housing 32 and the sleeve 34, but may prevent relative rotation between the outer housing and the sleeve. The anti-rotation device 36 may transmit torque between the outer housing 32 and the sleeve 34.

The line 22 may comprise one or more of a hydraulic line, an electrical line and an optical line.

A method of installing a line 22 in a well tool 20 is provided which includes the steps of: making-up one or more threaded connections T at a position between end connectors 24, 26 of the well tool 20; and preventing relative rotation between ends of a line 22 extending between the connectors 24, 26 during the threaded connection making-up step.

The threaded connections T may be made-up between the connector 24 and an inner mandrel 28 of the well tool 20. The threaded connections T may be made-up between the connector 24 and an outer housing 32 of the well tool 20. The threaded connections T may be made-up between an outer housing 32 and an anti-rotation device 36 which prevents relative rotation between the outer housing and a sleeve 34 secured to the connector 26.

The anti-rotation device 36 may permit relative longitudinal displacement between the outer housing 32 and the sleeve 34. The anti-rotation device 36 may transmit torque between the outer housing 32 and the sleeve 34. The anti-rotation device 36 may comprise a projection 38 engaged in a longitudinally extending recess 40.

The recess 40 may be formed externally on the sleeve. The projection 38 may be engaged with the recess 40 after the step of making-up the threaded connections T.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A well tool for use in conjunction with a subterranean well, the well tool comprising:

separate first and second members, the first and second members comprising end connectors positioned at opposite ends of the well tool;

a line extending between the first and second members;

at least one threaded connection which prevents unrestrained displacement of the first member relative to the second member; and an anti-rotation device which permits make-up of the at least one threaded connection without significant relative rotation between the first and second members.

2. The well tool of claim 1, wherein the line is coiled about an inner mandrel secured to the first member.

3. The well tool of claim 2, wherein the line is secured to the first member and to a sleeve reciprocably disposed on the inner mandrel and secured to the second member.

4. The well tool of claim 3, wherein the sleeve is reciprocably disposed within an outer housing secured to the first member.

5. The well tool of claim 4, wherein the anti-rotation device permits relative longitudinal displacement between the outer housing and the sleeve, but prevents relative rotation between the outer housing and the sleeve.

6. The well tool of claim 5, wherein the anti-rotation device transmits torque between the outer housing and the sleeve.

7. The well tool of claim 1, wherein the line comprises at least one of a hydraulic line, an electrical line and an optical line.

8. A method of installing a line in a well tool, the method comprising the steps of:

making-up a threaded connection which prevents unrestrained displacement of a first member of the well tool relative to a separate second member of the well tool, the first and second members comprising end connectors positioned at opposite ends of the well tool; and preventing significant relative rotation between the first and second members during the threaded connection making-up step, while the line extends between the first and second members.

9. The method of claim 8, wherein the threaded connection is made-up between the first member and an inner mandrel of the well tool.

10. The method of claim 8, wherein the threaded connection is made-up between the first member and an outer housing of the well tool.

11. The method of claim 8, wherein the threaded connection is made-up between an outer housing and an anti-rotation device, the anti-rotation device preventing relative rotation between the outer housing and a sleeve secured to the second member when the well tool is assembled.

12. The method of claim 11, wherein the anti-rotation device permits relative longitudinal displacement between the outer housing and the sleeve.

13. The method of claim 11, wherein the anti-rotation device transmits torque between the outer housing and the sleeve.

14. The method of claim 11, wherein the anti-rotation device comprises a projection engaged in a longitudinally extending recess.

15. The method of claim 14, further comprising the step of forming the recess externally on the sleeve.

16. The method of claim 14, further comprising the step of engaging the projection with the recess after the step of making-up the threaded connection.

* * * * *